US005418983A

United States Patent [19]

Garguillo et al.

[11] Patent Number: 5,418,983

[45] Date of Patent: May 30, 1995

[54] DECORATIVE COLOR CHANGEABLE BASKET SINK STRAINER

[75] Inventors: Richard Garguillo, Sayville, N.Y.; Israel Gajer, Delray Beach, Fla.

[73] Assignee: Jameco Industries, Inc., Wyandanch, N.Y.

[21] Appl. No.: 252,239

[22] Filed: Jun. 1, 1994

[51] Int. Cl.[6] ..... A47K 1/14; E03C 1/26

[52] U.S. Cl. ..... 4/287; 4/286; 4/290

[58] Field of Search ..... 4/286, 287, 288, 289, 4/290, 291, 292, 293, 294, 295

[56] References Cited

U.S. PATENT DOCUMENTS

| | | | |
|---|---|---|---|
| 2,090,299 | 8/1937 | Kuhnle | 4/287 |
| 2,890,463 | 6/1959 | Young | 4/287 |
| 2,905,951 | 9/1959 | Weddendorf, Jr. | 4/287 |
| 3,777,320 | 12/1973 | Politz | 4/287 |
| 3,800,339 | 4/1974 | Bergin | 4/287 |
| 5,165,118 | 11/1992 | Cendrowski | 4/287 |
| 5,265,281 | 11/1993 | McAlpine | 4/287 |
| 5,318,230 | 6/1994 | Ferguson et al. | 241/46.013 |

*Primary Examiner*—Robert M. Fetsuga
*Attorney, Agent, or Firm*—Fish & Richardson

[57] ABSTRACT

A changeable sink strainer in a drain opening of a sink has a strainer body installed between the sink and a waste pipe. A threaded receiver including a flanged nut is mounted within and at a lower end of the strainer body. A decorative insert is removably disposed within the strainer body. A hollow securing element, e.g. a screw or bolt, removably engages a lower end of the decorative insert within the strainer body and threadably engages the threaded receiver to removably secure the decorative insert to the strainer body. A basket strainer with a depending stem retains the basket strainer within the strainer body. The stem has a retractable element for removably retaining the stem in the hollow securing element.

4 Claims, 3 Drawing Sheets

DECORATIVE COLOR CHANGEABLE BASKET SINK STRAINER

FIELD OF THE INVENTION

Basket strainer assemblies primarily for kitchen sinks.

BACKGROUND OF THE INVENTION

Basket sink strainer assemblies are in conventional use in kitchen sinks to prevent food cuttings, scrapings, pieces and assorted other material from washing down the drain and eventually clogging the waste plumbing. The basket strainer is easily removable from the drain body by hand so that the captured waste can be dumped in the garbage, the strainer rinsed under the tap and replaced in the sink drain body.

The basket strainer's easy removability makes it simple to replace when damaged, or for decorative purposes such as when supplied in varying colors. The drain body, on the other hand, is a fixture mounted between the sink and the waste plumbing and is not easily changeable short of calling a plumber or doing the plumbing oneself. The decorative aspect of the drain body is, for all practical purposes, limited to its original color or material, frequently stainless steel with a polished flange, as deteriorates over time and with wear.

SUMMARY OF THE INVENTION

The present invention accordingly provides a method for changing the decor, appearance or color of the drain body while at the same time allowing the use of removable basket sink strainers which have a ball-stem holding means.

The present invention provides changeable insert means for the drain body with removable securing means adapted to receive the ball-stem of a basket strainer. The insert means is secured in the body by hollow threaded screw or bolt means which is removable by a simple conventional household tool such as a screwdriver. The basket has a stem with a protruding ball which is inserted into the hollow threaded screw means. The insert covers the body when installed therein and the basket is inserted into the body and insert.

DESCRIPTION OF A PREFERRED EMBODIMENT

Figure 1:
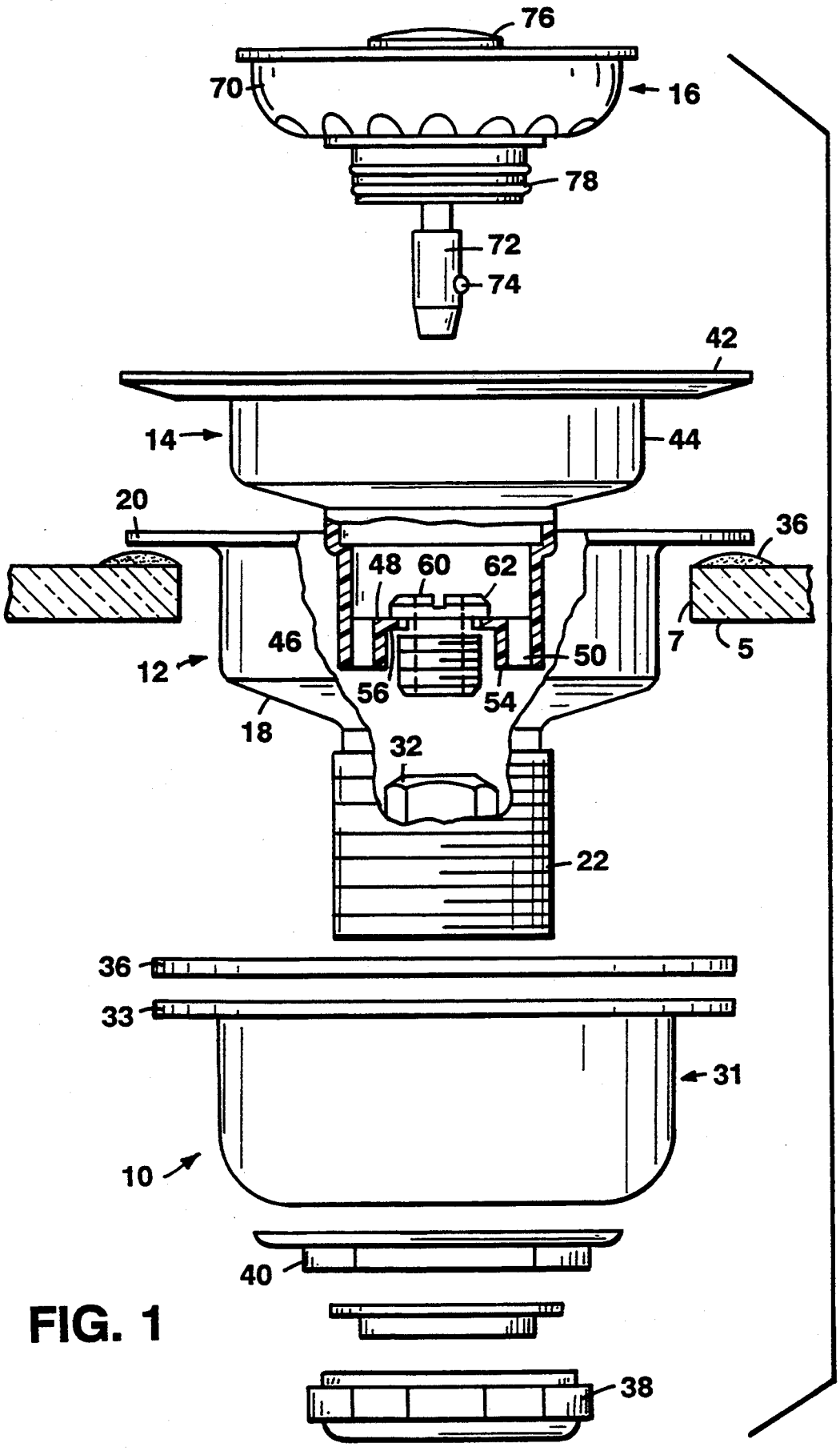
FIG. 1 is an exploded assembly view, partly cut away and partly in cross-section, of the decorative color changeable basket sink strainer of the invention.
Figure 2:
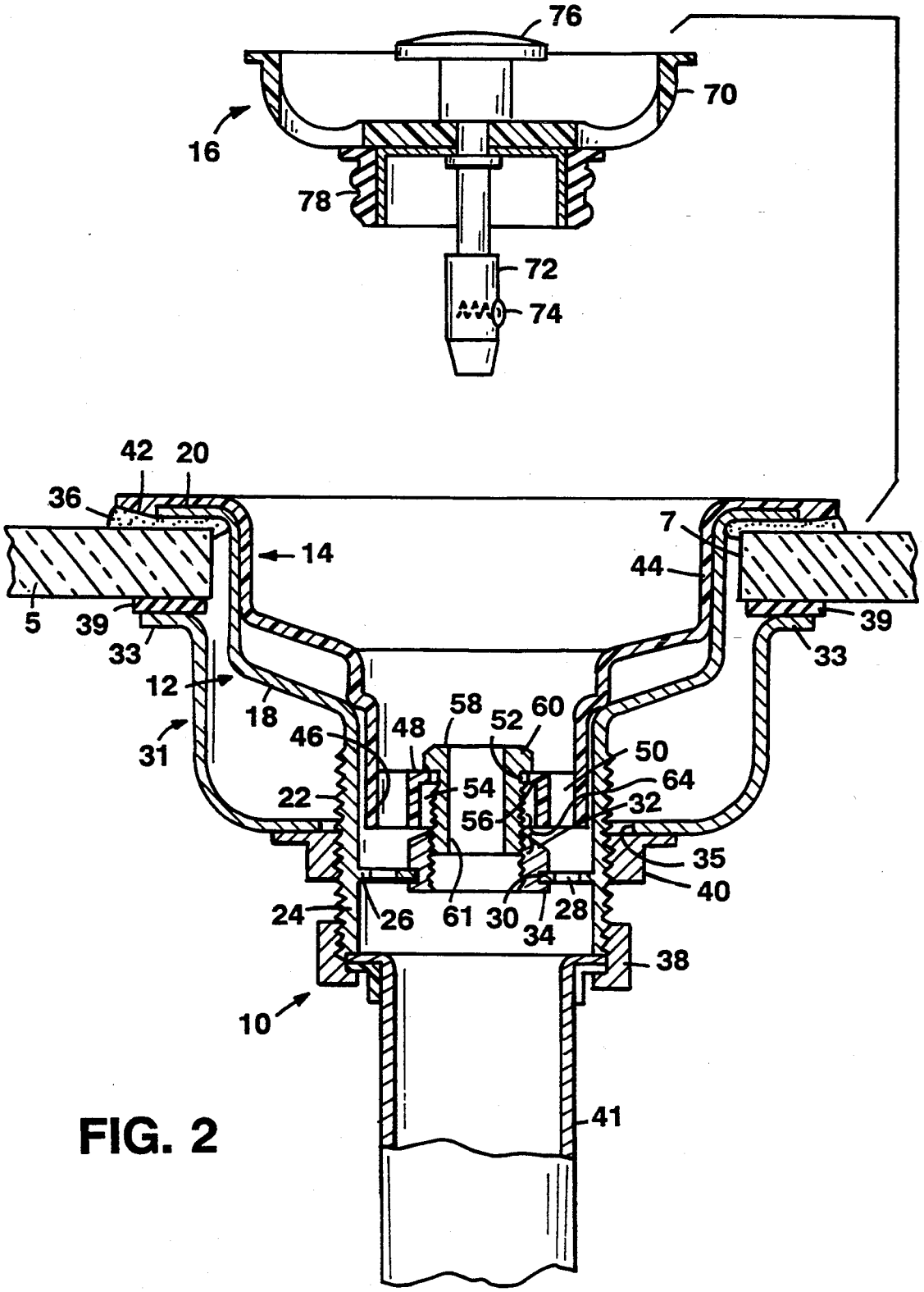
FIG. 2 is a cross-sectional view of the decorative color changeable basket sink strainer of the invention shown installed in a sink drain opening, with the basket assembly in position to be inserted therein.
Figure 3:
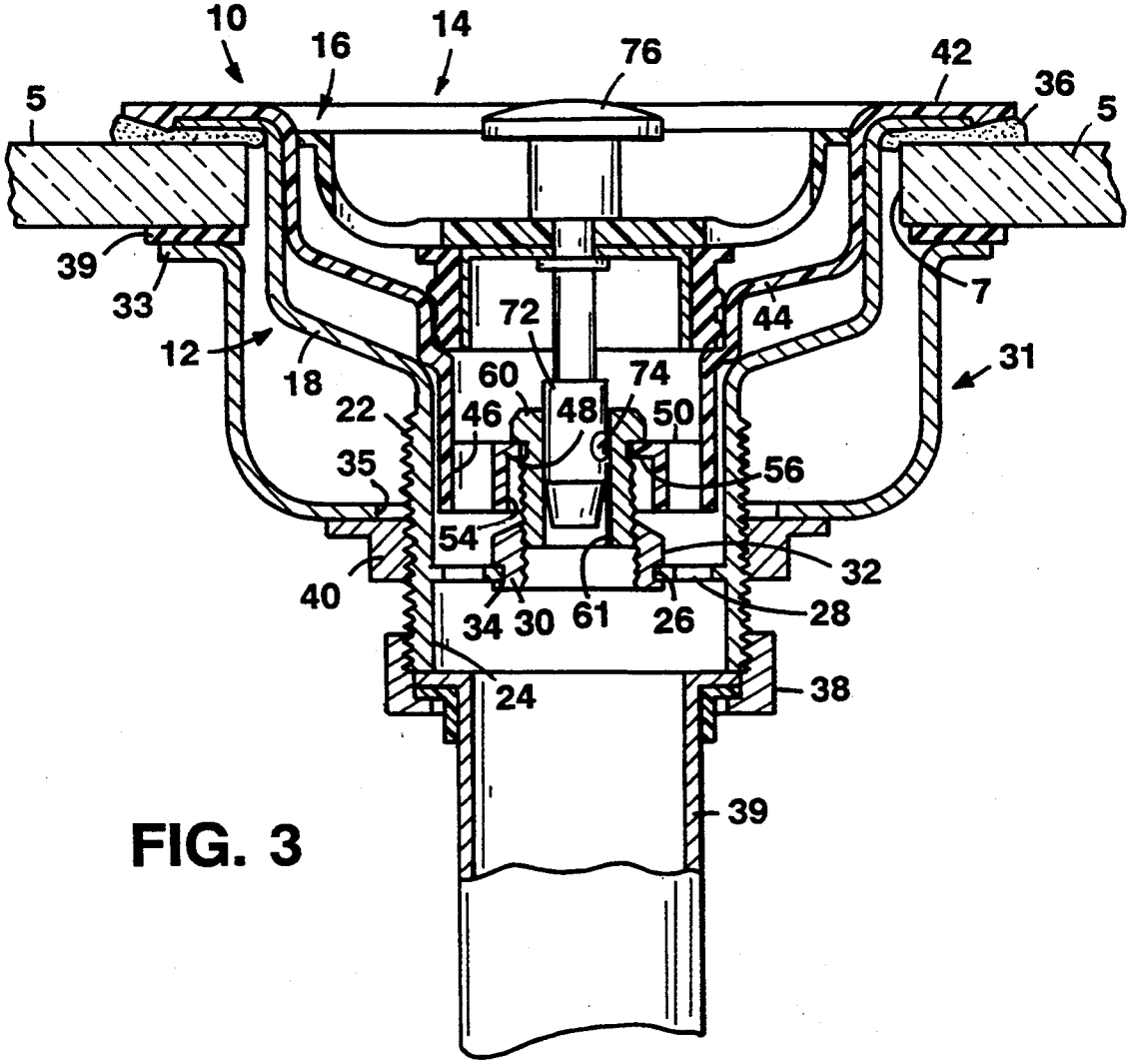
FIG. 3 is a cross-sectional view of the decorative color changeable basket sink strainer of the invention shown installed in a sink drain opening, with the basket assembly inserted therein.

With reference to the drawing, the decorative color changeable basket sink strainer assembly 10 of the invention comprises a strainer body 12, a decorative insert 14, a basket assembly 16 and a cup member 31, hereinafter described, for use with a sink 5 having a bottom drain hole 7.

Strainer body 12 is conventionally cup-shaped in mid-section 18 with a circumferential rim 20 as its top and a lower end 24 having externally threaded section 22. Lower end 24 has a substantially flat recessed bottom 26 in which are formed drain holes 28 and a hole 30 located axially of strainer body 12. A threaded nut 32, having a ring-shaped recess or flange 34, which is inserted into hole 30, is fastened, such as by soldering, to bottom 26 of strainer body 12. Threaded nut 32 is accordingly axially located with respect to strainer body 12. Circumferential rim 20 sits on the top of sink bottom 5, with a gasket, washer or sealant 36 sealing therebetween, and the remainder of strainer body 12 extending down through drain hole 7 of sink bottom 5. Strainer body 12 may be stainless steel or brass and circumferential rim 20 may be polished for appearance.

A cup member 31 having a flanged top 33 and a bottom opening 35 is positioned under sink 5 at drain hole 7, with threaded section 22 of strainer body 12 passes through bottom opening 35 of cup member 31. A locknut 40 engages threaded section 22 and cup member 31, pressing cup member 31 upwardly until flanged top 33 thereof engages against the underside of sink bottom 5. A washer, gasket or sealant 39 is placed between flanged top 33 and the underside of the sink. Further tightening of locknut 40 draws circumferential rim 20 and flanged top 33 axially together, thereby clamping strainer body 12 and cup member 31 to sink bottom 5 through drain hole 7.

Threaded section 22 is threadedly attached by means of slipnut 38 to the conventional drain plumbing, particularly to the tailpiece 41, which connects strainer body 12 to the under sink trap and to the rest of the waste plumbing, not shown.

Decorative insert 14 is intended to fit closely in and on top of strainer body 12 and accordingly has a similar shape, with a decorative rim 42 intended to sit on and cover strainer body circumferential rim 20, a cup-shaped mid-section 44 adapted to sit on and within strainer body mid-section 18 and a lower end 46 having a recessed substantially flat horizontal bottom member 48 in which are formed drain holes 50 and an axially located aperture 52. The underside of lower end 46 of insert 14 is provided with an axially located recess 54, the diameter of which is slightly greater than the diameter of threaded nut 32, so that recess 54 is adapted to receive threaded nut 32 when decorative insert 14 is seated in strainer body 12. Aperture 52 extends to and communicates with recess 54. The diameter of aperture 52 is less than the diameter of recess 54, and there is formed an annular seat 56 therebetween. The top 58 of threaded nut 32, opposite ring-shaped flange 34, may optionally rest against annular seat 56 when decorative insert 14 is seated in strainer body 12. Decorative insert 14 may accordingly be inserted into and removed from strainer body 12. When inserted, it completely covers strainer body 12, including circumferential rim 20, from view from above.

Decorative insert 14 is secured in strainer body 12 by hollow screw means 60 which threadedly engages threaded nut 32 and which has an axial bore 61. Screw means 60 has a head 62 which is larger in diameter than the diameter of aperture 52 and a threaded shank 64 which is smaller in diameter than the diameter of aperture 52. Shank 64 accordingly can pass through aperture 52 to engage threaded nut 32, holding annular seat 56 and thereby holding decorative insert 14 in place in strainer body 12. Head 62 of screw means 60 is slotted to receive a common screwdriver and can easily be tightened or removed so that decorative insert 14 is removably secured to strainer body 12. Decorative insert 14 is accordingly easily replaceable and, if made of suitable plastic and offered in different colors, provides a color changeable decorative insert for a sink strainer.

Basket assembly 16 is conventionally provided with a strainer basket 70, a stem 72 having a spring-retractable ball retainer 74, a pull knob 76 and a stopper cup 78. Strainer basket 70 is adapted to seat in cup-shaped mid-section 44 of decorative insert 14 when the insert is seated in strainer body 12. Stem 72 extends downwardly into bore 61 of hollow screw means 60 and retractable ball retainer 74 engages the wall of bore 61 to smoothly hold basket assembly 16 in place in insert 14 and in strainer body 12. Pulling upwardly on knob 76 withdraws stem 72 from bore 61 and removes basket assembly 16 from strainer body 12 while leaving insert 14 held in place by hollow screw means 60.

It will be seen that hollow screw means 60 constitutes hollow securing means which cooperates with strainer body-mounted flanged nut 32 to removably secure decorative insert 14 and basket strainer assembly 16 in strainer body 12, allowing each to be individually removable. Hollow screw means 60 is preferably made of brass, as is flanged nut 32. As used herein, top, bottom, up and other directional terms are with respect to normal installation in a drain hole at the bottom of a sink.

What is claimed is:

1. A changeable sink strainer for installation in a drain opening of a sink, comprising:

a) a hollow strainer body adapted for installation between the sink and a waste pipe, b) a threaded receiving member comprising a flanged nut mounted within and at a lower end of said strainer body, c) a decorative insert removably disposed within said strainer body, d) hollow securing means for removable engagement with a lower end portion of said decorative insert within said strainer body, said hollow securing means threadably engaging said receiving member to removably secure said decorative insert to said strainer body, and e) a basket strainer comprising a depending stem for retaining said basket strainer within said strainer body, said stem comprising a retractable member for removably retaining said stem in said hollow securing means.

2. The changeable sink strainer of claim 1, wherein said decorative insert comprises an inner bottom wall spaced from a lower end of said decorative insert, said inner bottom wall defining an axially located aperture surrounded by an annular seat positioned for engagement by said hollow securing means.

3. The changeable sink strainer of claim 2, wherein said decorative insert, between said inner bottom wall and said lower end, defines an axially located recess communicating with said aperture and sized for receiving at least a portion of said flanged nut therewithin.

4. The changeable sink strainer of claim 3, wherein said flanged nut has a predetermined outer diameter, said aperture has a diameter less than said outer diameter of said flanged nut, and said recess has a diameter greater than at least a portion of said outer diameter of said flanged nut.

* * * * *